US007062203B2

(12) United States Patent
Kim

(10) Patent No.: US 7,062,203 B2
(45) Date of Patent: Jun. 13, 2006

(54) DEVELOPING UNIT OF LIQUID ELECTROPHOTOGRAPHIC IMAGE FORMING APPARATUS

(75) Inventor: Wan-ha Kim, Suwon-si (KR)

(73) Assignee: Samsung Electronics Co., Ltd., Suwon-city (KR)

( * ) Notice: Subject to any disclaimer, the term of this patent is extended or adjusted under 35 U.S.C. 154(b) by 175 days.

(21) Appl. No.: 10/735,728

(22) Filed: Dec. 16, 2003

(65) Prior Publication Data

US 2004/0213602 A1 Oct. 28, 2004

(30) Foreign Application Priority Data

Apr. 24, 2003 (KR) ..... 10-2003-0026011

(51) Int. Cl.
*G03G 15/10* (2006.01)

(52) U.S. Cl. ..... 399/238; 399/237

(58) Field of Classification Search ..... 399/258, 399/262, 260, 237, 238
See application file for complete search history.

(56) References Cited

U.S. PATENT DOCUMENTS

| | | | | |
|---|---|---|---|---|
| 5,398,849 | A * | 3/1995 | Smith et al. | 399/262 |
| 6,128,453 | A * | 10/2000 | Ban et al. | 399/262 |
| 2002/0150829 | A1 * | 10/2002 | Zhao et al. | 399/237 |

FOREIGN PATENT DOCUMENTS

| | | |
|---|---|---|
| JP | 11-194600 | 7/1999 |
| JP | 2000-275945 | 10/2000 |
| JP | 2001-201925 | 7/2001 |
| JP | 2001-222158 | 8/2001 |

* cited by examiner

*Primary Examiner*—Susan Lee
(74) *Attorney, Agent, or Firm*—Roylance, Abrams, Berdo & Goodman, LLP

(57) ABSTRACT

A developing unit of a liquid electrophotographic image forming apparatus. The developing unit includes a developing roller, which supplies ink to a photosensitive medium on which an electrostatic latent image is formed, to develop the electrostatic latent image. The apparatus also includes an ink storage unit adapted to store ink to be supplied to the developing roller, and an ink cartridge, which is installed in the ink storage unit to be opened or closed and supplies ink to the ink storage unit. The ink cartridge includes a cartridge sleeve rotatably installed, and a cartridge slider, which slides by rotation of the cartridge sleeve to open the ink cartridge.

9 Claims, 4 Drawing Sheets

DEVELOPING UNIT OF LIQUID ELECTROPHOTOGRAPHIC IMAGE FORMING APPARATUS

BACKGROUND OF THE INVENTION

This application claims the priority of Korean Patent Application No. 2003-26011, filed on Apr. 24, 2003, in the Korean Intellectual Property Office, the disclosure of which is incorporated herein in its entirety by reference.

FIELD OF THE INVENTION

The present invention relates to a liquid electrophotographic image forming apparatus. More particularly, the present invention relates to a developing unit of a liquid electrophotographic image forming apparatus in which a developing operation is performed using high concentration ink.

DESCRIPTION OF THE RELATED ART

In general, electrophotographic image forming apparatuses form an electrostatic latent image corresponding to a desired image by radiating light on a photosensitive medium, form a toner image by supplying a developing agent in which a liquid carrier is mixed with toner particles to the electrostatic latent image, transfer the developed toner image onto a sheet of paper, and fuse the toner image on the sheet of paper, thereby forming an image.

FIG. 1 shows a structure of a conventional liquid electrophotographic image forming apparatus using a low-concentration developing agent having a toner concentration of approximately 2.5–3% solid. Referring to FIG. 1, the conventional liquid electrophotographic image forming apparatus includes a photosensitive belt 20 charged by a charger 10 at a predetermined electric potential. The apparatus also includes a laser scanning unit (LSU) 40 which forms an electrostatic latent image corresponding to a desired image by radiating light on the charged surface of the photosensitive belt 20. The apparatus includes a developing unit 30 which forms a toner image by supplying a developing agent to the photosensitive belt 20 and developing the electrostatic latent image. The apparatus also includes a transfer roller 50 which transfers the toner image developed on the photosensitive belt 20 onto a sheet of paper S, and a fusing roller 60 which fuses the toner image on the sheet of paper S by heating the sheet of paper S at a predetermined temperature and pressurizing the sheet of paper S.

After high-concentration ink of about 25% solid is removed from an ink reservoir 34, mixed with a liquid carrier by a mixer 35, diluted and made into a low-concentration developing agent having a toner concentration of around 2.5–3% solid, the low-concentration developing agent is supplied to a developing container 33 using a pump 36. In this case, the liquid carrier is supplied from a carrier reservoir 37.

Meanwhile, since a low-concentration developing agent is used in the conventional liquid electrophotographic image forming apparatus, in order to form a toner image by supplying a sufficient amount of toner to the electrostatic latent image, the developing agent stored in the developing container 33 is spread between the photosensitive belt 20 and a developing roller 31. Then, the developing agent attached to a non-image region except for the electrostatic latent image is removed using a set roller 38, and the overspread developing agent is removed using a squeeze roller 32.

The toner image formed on the photosensitive belt 20 is transferred to the transfer roller 50 after a drying operation is performed. The fusing roller 60 is rotated while being engaged with the transfer roller 50, and the sheet of paper S is transferred therebetween. Then, the toner image is transferred onto the sheet of paper S and fused on the sheet of paper S by heat and pressure of the transfer roller 50 and the fusing roller 60.

As described above, in the liquid electrophotographic image forming apparatus using a low-concentration developing agent, high-concentration ink is diluted and used. Thus, the liquid electrophotographic image forming apparatus should include an ink reservoir 34, a mixer 35, and a pump 36. Accordingly, a structure of the liquid electrophotographic image forming apparatus becomes very complicated.

In order to solve this problem, a liquid electrophotographic image forming apparatus has been suggested in which high-concentration ink having a toner concentration more than 3% solid is not diluted and used without changes. Since such a liquid electrophotographic image forming apparatus does not require a process of diluting high-concentration ink, there is no need for a mixer and a pump. Since a developing agent is not spread, a squeeze roller and a set roller need not be provided. Accordingly, the structure of the liquid electrophotographic image forming apparatus becomes simple and compact.

Meanwhile, in the liquid electrophotographic image forming apparatus using high-concentration ink, it is preferable that high-concentration ink and a liquid carrier are stored in a developing unit. In this case, if the developing unit is not completely sealed, when the developing unit is moved, the developing unit may be inclined, and ink, a liquid carrier or a developing agent in which ink is mixed with a liquid carrier, may leak.

SUMMARY OF THE INVENTION

The present invention provides a developing unit of a liquid electrophotographic image forming apparatus having an improved structure in which ink does not leak, even though the developing unit is moved or inclined when being supplied to a user.

According to an aspect of the present invention, there is provided a developing unit of a liquid electrophotographic image forming apparatus. The developing unit includes a developing roller, which supplies ink to a photosensitive medium on which an electrostatic latent image is formed, to develop the electrostatic latent image. The developing unit also includes an ink storage unit for storing ink to be supplied to the developing roller, and an ink cartridge, which is installed in the ink storage unit to be opened or closed and supplies ink to the ink storage unit. The ink cartridge includes a cartridge sleeve rotatably installed, and a cartridge slider, which slides by rotation of the cartridge sleeve to open the ink cartridge.

It is preferable that a rotation shaft is provided in the center of the cartridge sleeve, a first screw portion being formed on an end of the rotation shaft, and a second screw portion corresponding to the first screw portion is formed at one side of the cartridge slider so that the cartridge slider slides by rotation of the rotation shaft.

An elastic member is installed between the cartridge slider and the developing container and applies an elastic force so that the cartridge slider is pushed toward the cartridge sleeve. Here, it is also preferable that at least one cartridge coupling is formed at one side of the cartridge slider in which the second screw portion is formed, and a guide coupling in which a coupling groove into which the cartridge coupling is inserted, is provided between the cartridge slider and the elastic member.

It is also preferable that a rotation groove is formed on an outer circumference of the cartridge sleeve, and a jaw corresponding to the rotation groove is formed in a developing container that forms outer walls of the developing unit. Here, it is also preferable that a knob unit is provided on an end of the cartridge sleeve protruding from an outside of the developing container so that the cartridge sleeve is rotated from the outside of the developing container.

It is also preferable that when the ink cartridge is closed, an ink sealing ring which prevents leakage of ink is provided on a surface where the cartridge sleeve contacts the cartridge slider.

It is also preferable that concentration of ink is more than 3% solid, and in particular, that the concentraion of ink is between 10 and 20%.

It is also preferable that an inclined angle at insides of the cartridge sleeve and the cartridge slider is greater than 7 degrees.

BRIEF DESCRIPTION OF THE DRAWINGS

The above aspects and advantages of the present invention will become more apparent in connection with the following detailed description of a preferred embodiment thereof with reference to the attached drawing figures, in which.

It will be understood that in the drawing figures, like reference numerals are intended to refer to like features and structures.

DETAILED DESCRIPTION OF THE INVENTION

Figure 1:
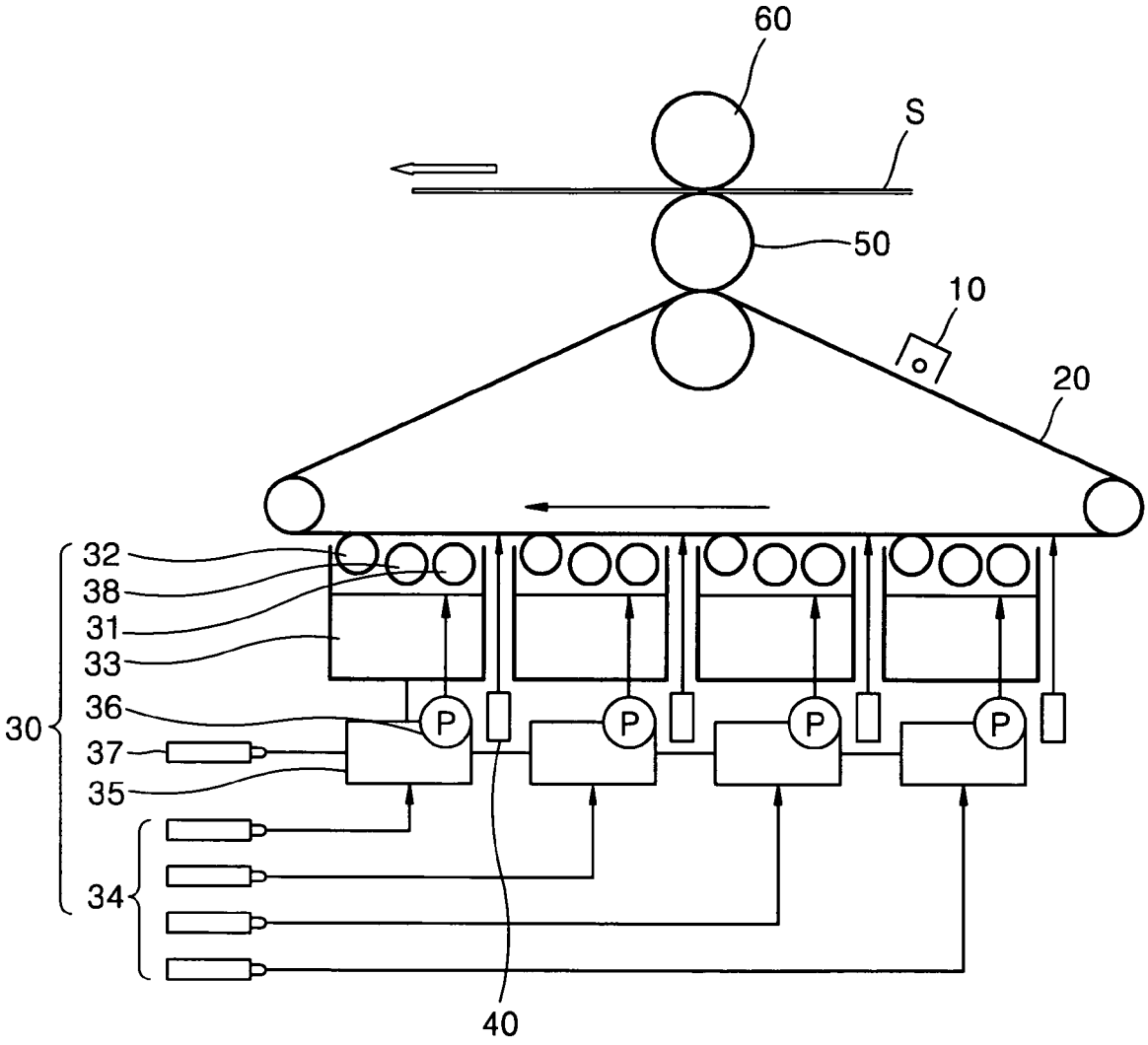
FIG. 1 (PRIOR ART)
FIG. 1 shows a structure of a conventional liquid electrophotographic image forming apparatus.
Figure 2:
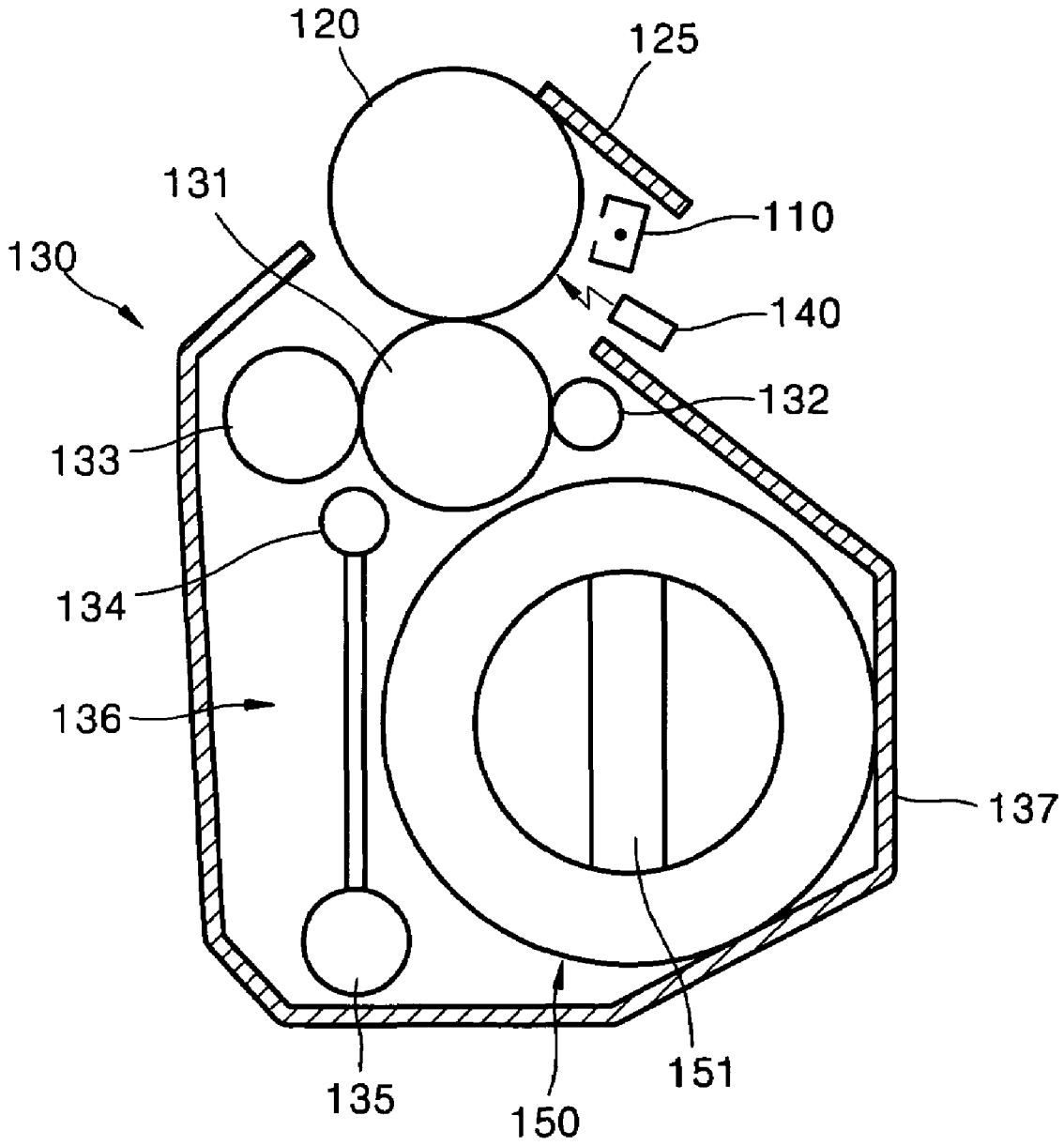
FIG. 2 schematically shows a structure of developing unit of a liquid electrophotographic image forming apparatus according to an embodiment of the present invention.

FIG. 2 schematically shows a structure of a developing unit of a liquid electrophotographic image forming apparatus according to an embodiment of the present invention. Referring to FIG. 2, a developing unit 130 includes a developing roller 131, an ink storage unit 136 storing ink supplied to the developing roller 131, and an ink cartridge 150, which supplies ink to the ink storage unit 136. Reference numeral 137 denotes a developing container that forms outer walls of the developing unit 130.

The developing roller 131 rotates while facing a photosensitive medium 120, and supplies ink to the photosensitive medium 120 on which an electrostatic latent image is formed by a laser scanning unit (LSU) 140, thereby developing the electrostatic latent image. Reference numeral 110 denotes a charger, which charges the photosensitive medium 120 to a predetermined electric potential, and reference numeral 125 denotes a photosensitive medium cleaning blade, which removes ink on the photosensitive medium 120 after a toner image formed on the photosensitive medium 120 is transferred onto a transfer body.

Meanwhile, a metering roller 132, which regulates the amount of ink transferred onto the surface of the developing roller 131, and a development cleaning roller 133, which removes ink on the surface of the developing roller 131 are provided on either side of the developing roller 131. The development cleaning roller 133 contacts the developing roller 131, is rotated in the same direction as the direction of the developing roller 131, and removes ink remaining on the surface of the developing roller 131.

The ink storage unit 136 stores ink supplied to the developing roller 131. A depositing roller 134, which supplies ink to the developing roller 131, is provided in the ink storage unit 136. The depositing roller 134 transfers ink onto the developing roller 131 using an electric force of a voltage applied from a depositing power supply unit (not shown). In this case, the depositing roller 134 may contact the developing roller 131 or be spaced-apart from the developing roller 131 by a predetermined gap. Meanwhile, pumping roller 135, pushes ink supplied from the ink cartridge 150 toward the depositing roller 134.

An ink cartridge 150, which supplies ink to the ink storage unit 136, is provided in the ink storage unit 136. The ink cartridge 150 is installed in the ink storage unit 136 to be opened or closed. As the ink cartridge 150 is opened, ink is supplied to the ink storage unit 136. Here, high-concentration ink having a toner concentration more than at or about 3% solid, and preferably having a toner concentration of at or about 10 to at or about 20% solid, is stored in the ink cartridge 150.

Figure 3A:
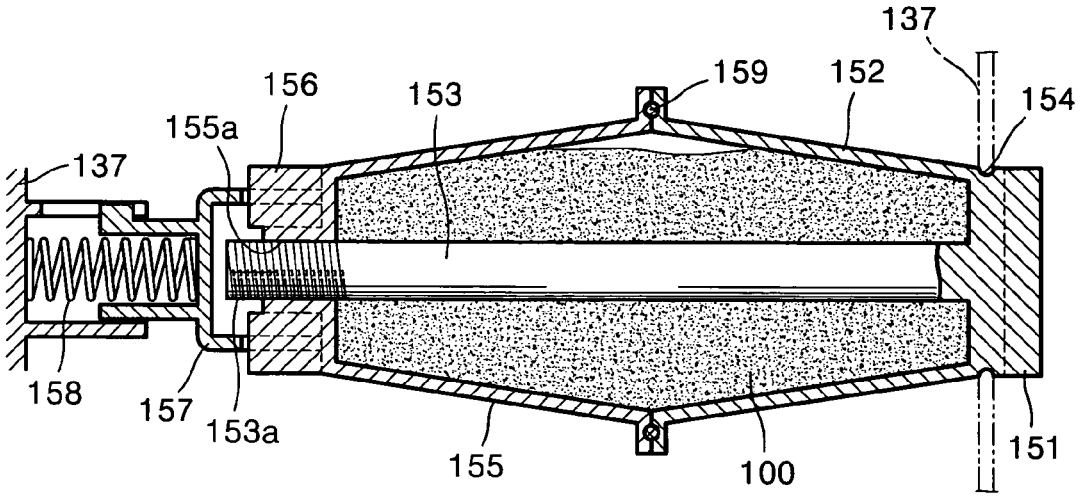
FIGS. 3A and 3B show a structure and operation of an ink cartridge used in the developing unit according to an embodiment of the present invention.
Figure 3B:
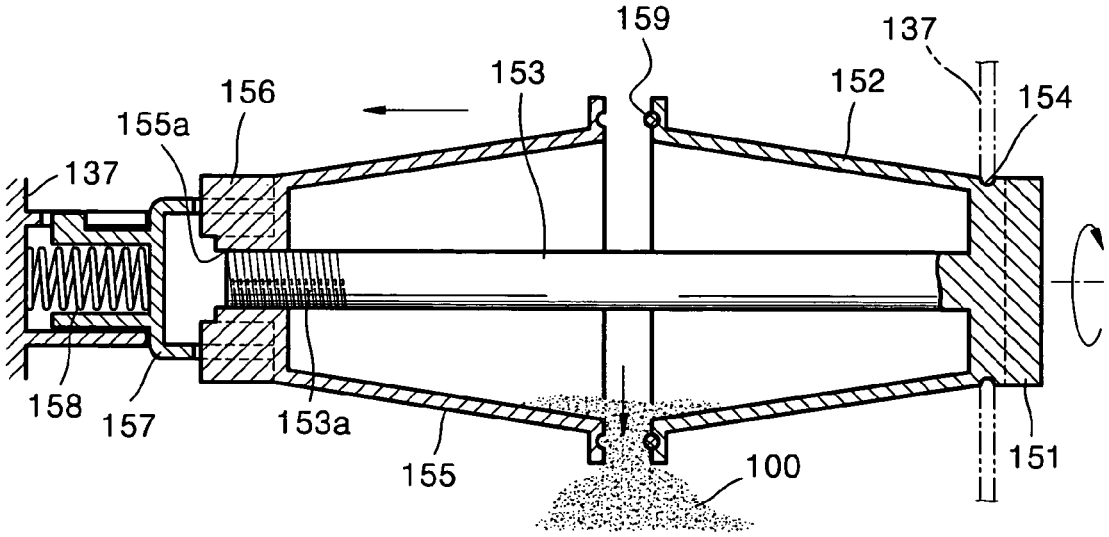
Figure 4:
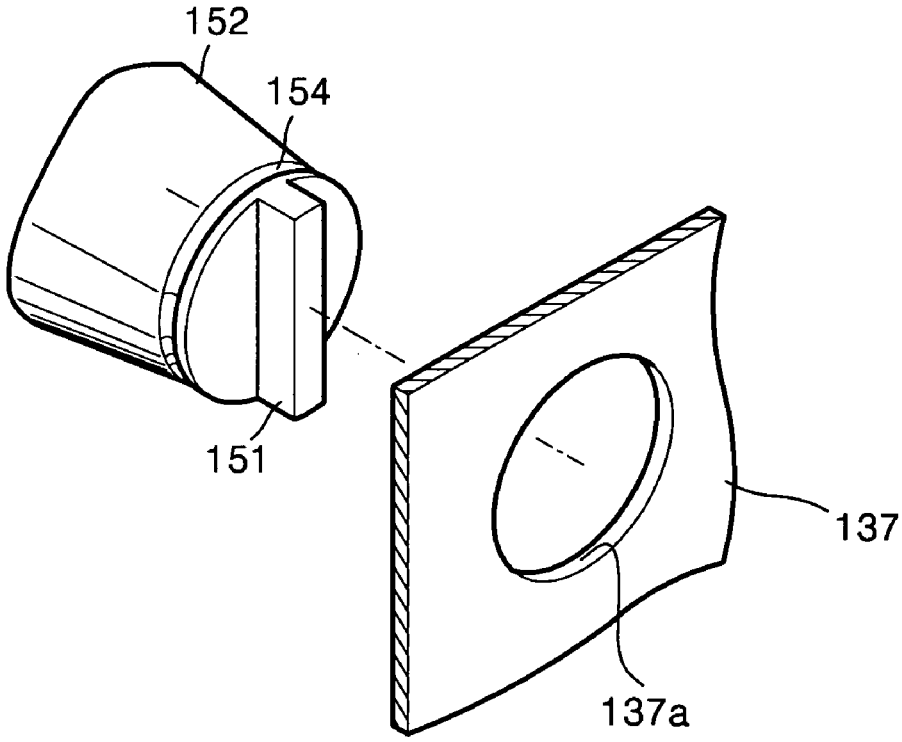
FIG. 4 shows a knob unit of the ink cartridge shown in FIG. 3.
Figure 5:
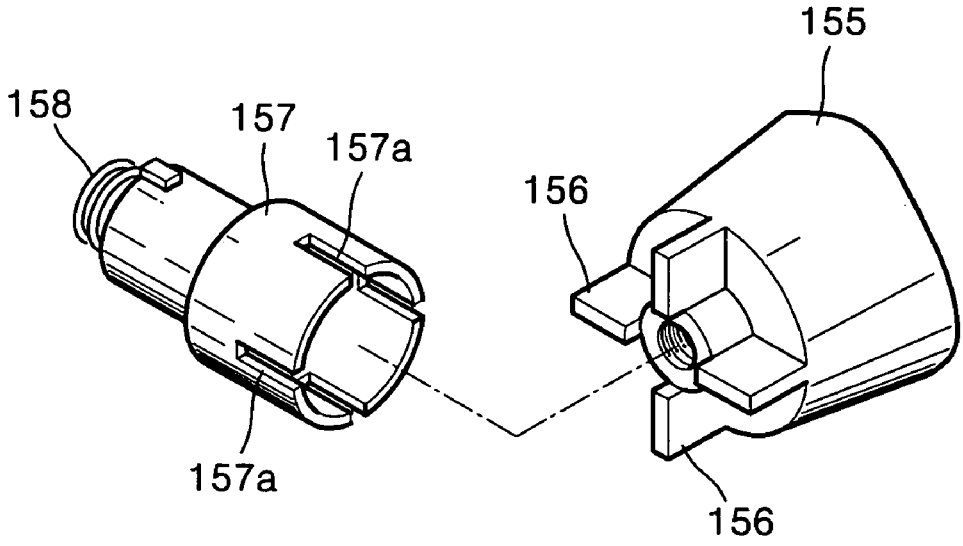
FIG. 5 shows a coupling unit of the ink cartridge shown in FIG. 3.

FIGS. 3A and 3B show a structure and operation of the ink cartridge 150, and FIGS. 4 and 5 are perspective views showing both ends of the ink cartridge 150.

Referring to FIGS. 3A, 3B, 4, and 5, the ink cartridge 150 includes a cartridge sleeve 152 rotatably installed, and a cartridge slider 155, which slides by rotation of the cartridge sleeve 152. Preferably, the insides of the cartridge sleeve 152 and the cartridge slider 155 are angled at an angle greater than at or about 7 degrees.

When the ink cartridge 150 is closed, the cartridge sleeve 152 is coupled with the cartridge slider 155, and ink 100 is stored in the ink cartridge 150. In this case, an ink sealing ring 159 is provided on a surface where the cartridge sleeve 152 contacts the cartridge slider 155, so that ink 100 does not leak.

A rotation groove 154 is formed on an outer circumference of the cartridge sleeve 152, and a jaw 137*a* corresponding to the rotation groove 154 is formed in a developing container 137. A knob unit 151 is formed on an end of the cartridge sleeve 152 protruding from an outside of the developing container 137 so that the cartridge sleeve 152 is rotated from the outside of the developing container 137.

A rotation shaft 153 is provided in the center of the cartridge sleeve 152. One end of the rotation shaft 153 is connected to the knob unit 151, and the other end thereof is connected to one side of the cartridge slider 155. A first screw portion 153*a* is formed on the other end of the rotation shaft 153, and a second screw portion 155*a* into which the first screw portion 153*a* is inserted is formed at one side of the cartridge slider 155 connected to the rotation shaft 153. As such, the cartridge slider 155 slides toward or away from the cartridge sleeve as the rotation shaft 153 is rotated.

A coupling spring 158 is provided between one side of the cartridge slider 155 and the developing container 137. The coupling spring 158 is fixedly installed in the developing container 137 and applies an elastic force so that the cartridge slider 155 is pushed toward the cartridge sleeve 152.

In addition, at least one cartridge coupling 156 is formed at one side of the cartridge slider 155. As will be appreciated by one of ordinary skill in the art, the number of cartridge couplings 156 can vary, and four cartridge couplings 156 are shown in the exemplary embodiment illustrated in FIG. 5.

Each of the cartridge couplings 156 is coupled with one side of a guide coupling 157. In other words, a coupling groove 157*a* corresponding to the cartridge coupling 156 is formed in the guide coupling 157, and the cartridge coupling 156 is inserted into the coupling groove 157*a*. The other side of the coupling groove 157 is connected to the coupling spring 158. Meanwhile, the guide coupling 157 is supported by the developing container 137 so that it is prevented from rotating relative to the developing container 137. Thus, when the cartridge sleeve 152 is rotated, the cartridge slider 155 is not rotated but slides in the direction allowed by the coupling groove 157.

The operation of a developing unit 130 having the above structure will now be described.

First, the coupling spring 158 is installed at an inside of the developing container 137, and the guide coupling 157 is mounted on the coupling spring 158. In this case, due to an elastic force, the guide coupling 157 is pushed out forward by the coupling spring 158.

Next, the ink cartridge 150 filled with high-concentration ink 100 is mounted in the ink storage unit 136. Specifically, the cartridge coupling 156 is engaged with the coupling groove 157*a* formed in the guide coupling 157, and the rotation groove 154 formed in the cartridge sleeve 152 is engaged with the jaw 137*a* formed in the developing container 137.

Subsequently, the developing roller 131, the development cleaning roller 133, the metering roller 132, and the depositing roller 134 are mounted in the developing container 137, thereby completing the construction of the developing unit 130.

FIG. 3A shows a case where the ink cartridge 150 of the developing unit 130 is closed before an image forming apparatus is used. FIG. 3B shows a case where the ink cartridge 150 of the developing unit 130 is opened and ink 100 is supplied to the ink storage unit 136 so that the image forming apparatus can be used.

Hereinafter, an operation of supplying high-concentration ink 100 stored in the ink cartridge 150 to the ink storage unit 136 will be described.

First, when the knob unit 151 protruding from the outside of the developing unit 137 is turned in a direction of an arrow shown in FIG. 3B, the cartridge sleeve 152 and the rotation shaft 153 are rotated. In this case, since the cartridge coupling 156 is engaged with the guide coupling 157, the cartridge slider 155 is not rotated. Because the first screw portion 153*a* formed on an end of the rotation shaft 153 is inserted into the second screw portion 155*a* of the cartridge slider, as the rotation shaft 153 is rotated, the cartridge slider 155 overcomes the spring force of the coupling spring 158 and slides to open the ink cartridge 150. As such, ink 100 stored in the ink cartridge 150 flows downward under the force of gravity. It has been experimentally ascertained that the insides of the cartridge sleeve 152 and the cartridge slider 155 should be inclined more than at or about 7 degrees so that high-concentration ink 100 flows downward under the force of gravity.

As described above, in the developing unit of the liquid electrophotographic image forming apparatus according to an embodiment of the present invention, the ink cartridge is maintained in a sealed state before the image forming apparatus is used. Thus, even though the developing unit is moved or inclined before use, ink can be prevented from leaking out of the developing unit.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A developing unit of a liquid electrophotographic image forming apparatus, the developing unit comprising:

a developing roller adapted to supply ink to a photosensitive medium on which an electrostatic latent image is formed, to develop the electrostatic latent image;

an ink storage unit adapted to store ink to be supplied to the developing roller;

an ink cartridge adapted to be installed in the ink storage unit, and to be opened or closed and to supply ink to the ink storage unit;

wherein the ink cartridge comprises a cartridge sleeve rotatably installed, and a cartridge slider, which slides by rotation of the cartridge sleeve to open the ink cartridge; and an ink sealing member provided on a surface where the cartridge sleeve contacts the cartridge slider that prevents leakage of ink when the ink cartridge is closed.

2. The developing unit of claim 1, wherein a rotation shaft is provided in the cartridge sleeve, a first screw portion being formed on an end of the rotation shaft, and a second screw portion corresponding to the first screw portion is formed at one side of the cartridge slider so that the cartridge slider slides by rotation of the rotation shaft.

3. The developing unit of claim 1, wherein an elastic member is installed between the cartridge slider and a developing container and applies an elastic force so that the cartridge slider is pushed toward the cartridge sleeve.

4. The developing unit of claim 3, wherein at least one cartridge coupling is formed at one side of the cartridge slider in which a screw portion is formed, and a guide coupling in which a coupling groove into which the cartridge coupling is inserted, is provided between the cartridge slider and the elastic member.

5. The developing unit of claim 1, wherein a rotation groove is formed on an outer circumference of the cartridge sleeve, and a jaw corresponding to the rotation groove is formed in a developing container that forms outer walls of the developing unit.

6. The developing unit of claim 1, wherein a knob unit is provided on an end of the cartridge sleeve protruding from an outside of a developing container so that the cartridge sleeve is adapted to be rotated from the outside of the developing container.

7. The developing unit of claim 1, wherein a concentration of ink is more than about 3% solid.

8. The developing unit of claim 1, wherein a concentration of ink is from about 10 to about 20% solid.

9. The developing unit of claim 1, wherein an inclined angle at insides of the cartridge sleeve and the cartridge slider is greater than about 7 degrees.

* * * * *